United States Patent [19]

Kuroda et al.

[11] Patent Number: 4,652,611

[45] Date of Patent: Mar. 24, 1987

[54] LOW-TEMPERATURE FLUIDITY IMPROVER

[75] Inventors: Katsuhiko Kuroda, Yokohama; Kiyoharu Yoshimi, Tokyo; Tsutomu Baba, Hatano, all of Japan

[73] Assignee: Mitsubishi Chemical Industries Limited, Tokyo, Japan

[21] Appl. No.: 562,586

[22] PCT Filed: Feb. 9, 1983

[86] PCT No.: PCT/JP83/00039

§ 371 Date: Dec. 12, 1983

§ 102(e) Date: Dec. 12, 1983

[87] PCT Pub. No.: WO83/03615

PCT Pub. Date: Oct. 27, 1983

[30] Foreign Application Priority Data

Apr. 12, 1982 [JP] Japan ..... 57-60565
Jun. 25, 1982 [JP] Japan ..... 57-109611

[51] Int. Cl.[4] ..... C08L 35/00; C10L 1/18

[52] U.S. Cl. ..... 525/207; 524/487; 44/62

[58] Field of Search ..... 525/207, 222; 524/487; 44/62

[56] References Cited

U.S. PATENT DOCUMENTS

| | | | |
|---|---|---|---|
| 4,175,926 | 11/1979 | Wisotsky | 44/62 |
| 4,192,930 | 3/1980 | Beck et al. | 525/207 |
| 4,334,038 | 6/1982 | Beck et al. | 525/207 |
| 4,518,509 | 5/1985 | Newberry | 44/62 |

*Primary Examiner*—Allan M. Lieberman
*Attorney, Agent, or Firm*—Oblon, Fisher, Spivak, McClelland & Maier

[57] ABSTRACT

The low-temperature fluidity improver comprising (A) an adduct formed by adding a reaction product having the weight average polymerization degree of 1 to 100, which is prepared from an α-olefin having the average carbon atom number of 10 to 30 and maleic anhydride, to an aliphatic alcohol having the average carbon atom number of 6 to 28, in which the sum of the average carbon atom number in the longest alkyl group chain of the α-olefin and the average carbon atom number in the longest carbon chain of the aliphatic alcohol is 22 to 40, and/or a salt of said adduct, and (B) a low molecular weight polyethylene having the numerical average molecular weight of 500 to 20,000 and/or a reaction product thereof with maleic anhydride.

3 Claims, No Drawings

LOW-TEMPERATURE FLUIDITY IMPROVER

DESCRIPTION

1. Technical Field

This invention relates to a low-temperature fluidity improver and, more specifically, it relates to an additive for improving the fluidity of hydrocarbon fuel oils at a low temperature.

2. Background Art

Hydrocarbon fuel oils, for example, light oils, A-type heavy oils and the likes contain n-paraffin wax ingredient and, accordingly, often result in the separation of the n-paraffin wax ingredient during winter seasons in cold districts, thereby causing significant problems for the fluidity of the fuels at a low temperature such as the blocking in oilfeed pipelines and plugging of strainers disposed in fuel supply circuits of internal combustion engines.

In order to solve the problems, additives generally referred to as a low-temperature fluidity improver have been used. Various low-temperature fluidity improvers including ethylene-vinyl acetate copolymers have been studied and proposed. For instance, there are known a copolymer of an ethylenically unsaturated dicarboxylic acid and an α-olefin as described in Japanese Patent Laid-Open No. 157106/1979, a copolymer of an ethylenically unsaturated dicarboxylic acid and an α-olefin esterified with a long-chained alcohol as described in Japanese Patent Publication No. 15005/1975 and a copolymer of an ethylenically unsaturated dicarboxylic acid and an α-olefin modified with an aliphatic amine as described in Japanese Patent Laid-Open No. 81307/1979. However, the effect of them can not be considered sufficient.

Recently, a method of blending a second ingredient or a third ingredient has been proposed with an aim of supplementing the effect of the additives mentioned above. For instance, there have been proposed a method as described in Japanese Patent Laid-Open No. 86505/1979 of using a second ingredient such as an ethylene-vinyl acetate copolymer together with the copolymer of the ethylenically unsaturated dicarboxylic acid and the α-olefin modified with the aliphatic amine as described in Japanese Patent Laid-Open No. 81307/1979, and a method as described in U.S. Pat. No. 4,210,424 of using n-paraffin wax and a nitrogen-containing compound as the second and the third ingredients together with an ethylene-vinyl acetate copolymer and the like, but they are still not effective to heavier light oils or heavy oils obtained from heavy crude oils such as Da Qing Oils and Minas Oils and the like containing a great amount of paraffin ingredient.

The present inventors have found the following interesting phenomena in the course of the study for pursuing the relationship between the state of wax separated from fuel oils at a low temperature and the effect of additives with regard to the low-temperature fluidity of the fuel oils.

That is, it is important for improving the low-temperature fluidity of fuel oils (1) to keep the crystal size of the wax separated at a low temperature as small as possible; and (2) to disperse the separated crystals of the wax stably in the oils, for which it has been found that a method of combining two different compounds having respective functions, that is, (1) a compound (fine-crystallizing agent) with a function of rendering the wax into fine crystals and (2) a compound (dispersing agent) with a funciton of dispersing the crystals of the wax stably in the oils is more reasonable and effective than the conventional method of attaining these different functions together in a single compound.

On the basis of the foregoing discovery, the present inventors have sought for compounds which are effective as the fine-crystallizing agent and the dispersing agent as well as the combination thereof, and then have accomplished the low-temperature fluidity improver of this invention.

DISCLOSURE OF INVENTION

The feature of this invention resides in a low-temperature fluidity improver comprising (A) an adduct formed by adding a reaction product having the weight average polymerization degree of 1 to 100, which is prepared from an α-olefin having the average carbon atom number of 10 to 30 and maleic anhydride, to an aliphatic alcohol having the average carbon atom number of 6 to 28, in which the sum of the average carbon atom number in the longest alkyl group chain of the α-olefin and the average carbon atom number in the longest carbon chain of the aliphatic alcohol is 22 to 40, and/or a salt of said adduct, and (B) a low molecular weight polyethylene having the numerical average molecular weight of 500 to 20,000 and/or a reaction product thereof with maleic anhydride.

This invention is to be described specifically hereinafter.

The ingredient A of the fluidity improver according to this invention is an adduct formed by adding a reaction product, which is prepared from an α-olefin having the average carbon atom number of 10 to 30 and maleic anhydride, to a higher alcohol, and/or a salt thereof. Said reaction product of the α-olefin and maleic anhydride includes an adduct of α-olefin and maleic anhydride in 1:1, as well as copolymers having the weight average polymerization degree of 100 or less, preferably, 45 or less. If the weight average polymerization degree exceeds 100, it is not preferred since the solubility to the fuel oil is poor and the effect for the low temperature fluidity is also poor.

The α-olefin used as the starting material for the ingredient A in this invention is an olefinic hydrocarbon having the average carbon atom number of 10 to 30 and having a double bond at the α-position of the hydrocarbon, and such α-olefin may be a single component or a mixture of α-olefins having different number of carbon atoms.

The copolymerizing reaction of α-olefin and maleic anhydride is carried out in a conventional manner in the presence of a radical initiator, while using an appropriate solvent, for example, benzene, toluene, xylene, methyl isobutyl ketone, dioxane and the like or without using solvent, at a temperature of 80° to 180° C.

The adduct of α-olefin and maleic anhydride corresponding to the polymerization degree of 1 can be obtained according to the conventional manner by heating α-olefin and maleic anhydride in the absence of solvent to 160° to 230° C.

After the reaction, the reaction product is recovered by removing a solvent, unreacted α-olefin and maleic anhydride by distillation under a reduced pressure.

The constituent molar ratio of α-olefin and maleic anhydride in the reaction product obtained by the reaction of α-olefin and maleic anhydride is usually between 1:1 to 1:2, any of which can be used.

The reaction product of α-olefin and maleic anhydride is then reacted with an aliphatic alcohol having one hydroxyl group. This alcohol usable includes those having straight or branched chain having the average carbon atom number of 6 to 28, preferably, 7 to 21. Although these alcohols may be a single component or a mixture of alcohols of different carbon atom number, it is required in this invention that the sum of the average carbon atom number in the longest carbon chain of the alcohol and the average carbon atom number in the longest alkyl group chain (moiety forming the side chain after polymerization) of the α-olefin (hereinafter referred to as the sum of the carbon atom number in the longest side chains) is in the range of 22 to 40, preferably, 24 to 34. If the sum of the carbon atom number is less than 22 or in excess of 40, the effect can scarcely be expected. In particular, for a composition where the ingredient A is an alcohol adduct formed by adding the reaction product of α-olefin and maleic anhydride to an alcohol and the ingredient B is a low molecular weight polyethylene, it is preferred that the sum of the carbon atom number in the longest side chains lies within a range of 26 to 35.

The reaction between the reaction product of α-olefin with maleic anhydride and the alcohol is carried out according to the conventional manner by heating to 60° to 140° C. while optionally using an acid catalyst and either in an appropriate solvent, for example, benzene, toluene, xylene, methyl ethyl ketone, dioxane and the like or without using such solvents.

An appropriate molar ratio of the alcohol for the reaction is preferably 1 to 2 molar times as much as the acid anhydride group in the reaction product of α-olefin and maleic anhydride. In the reaction product, it is preferred that the alcohol is added by 0.5 to 1.5 mol in average to one mol of the anhydride group.

After completion of the reaction and then removing the acid catalyst by washing with water, the alcohol adduct (hereinafter referred to simply as the adduct) may be obtained by removing the solvent, the unreacted alcohol and the like by distillation.

The salt of the adduct as mentioned above can be obtained by a conventional manner. For instance, the salt of the adduct as described above can be obtained by heating to 40° to 140° C. either in a solvent, for instance, benzene, toluene, xylene and the like or in the absence of solvent, together with a hydroxide such as potassium hydroxide, sodium hydroxide, ammonium hydroxide and the like and then removing the produced water from the reaction system.

The adduct and/or the salt thereof thus obtained may be used together with a fine-crystallizing agent for the wax to be described below and functions as a dispersing agent for the fine-crystallized wax.

A low molecular weight polyethylene with the number average molecular weight of 500 to 20,000 or a reaction product thereof with maleic anhydride is used as the fine-crystallizing agent (ingredient B) for the wax. As the low molecular weight polyethylene, α-olefin or polyethylene wax obtained by a low polymerization of ethylene or grease wax obtained as a by-product upon production of high molecular weight polyethylene can be used. If the numerical average molecular weight of the low molecular weight polyethylene is less than 500, its fine-crystallizing effect is poor due to the insufficient interaction with the wax contained in the fuel oil, and if the numerical average molecular weight exceeds 20,000, it is not preferred since the solubility to the fuel oil is poor.

The reaction product of a low molecular weight polyethylene and maleic anhydride can be obtained according to a conventional manner by mixing the low molecular weight polyethylene and 0.1 to 40 wt% of maleic anhydride based thereon and heating them in the presence or absence of a radical initiator thereby to carry out copolymerizing reaction or grafting reaction.

An appropriate ratio of the ingredient B to be used to the ingredient A is in the range of 0.1 to 10 times by weight, preferably, 0.5 to 2 times by weight.

The low-temperature fluidity improver comprising the ingredient A and the ingredient B thus obtained can significantly improve the low-temperature fluidity by adding 10 to 10,000 ppm, preferably, 50 to 1,000 ppm thereof to hydrocarbon fuel oils.

As described above specifically, according to this invention, an excellent effect for the low-temperature fluidity can be given to fuel oils by jointly using two ingredients which will show only an insufficient effect for the low-temperature fluidity if each of them is used singly.

BEST MODE FOR CARRYING OUT THE INVENTION

This invention will be explained below referring to Examples.

Method of measuring the weight average polymerization degree and the method of testing the low-temperature fluidity were conducted by the procedures shown below.

(1) Method of Measuring the Weight Average Polymerization Degree (Pw)

It was calculated through gel permeation chromatography (G.P.C.) by using a calibration curve of standard polystyrene and according to the following equation:

$$Pw = \frac{\Sigma NiPi^2}{\Sigma NiPi}$$

wherein

Pw: weight average polymerization degree,

Ni: number of molecules for the molecule i,

Pi: polymerization degree for the molecule i.

The measurement was carried out by using a high speed liquid chromatograph HLC-802 UR manufactured by Toyo Soda Kogyo, K. K. under the following conditions:

Solvent: THF (Tetrahydrofuran)

Column: 4000, 3000, 2000×2 (a column manufactured by Toyo Soda Kogyo, K. K.)

Temperature: 40° C.

Flow speed: 1.2 ml/min.

(2) Method for Testing Low-Temperature Fluidity

The low-temperatue fluidity was estimated by measuring the pour point according to JIS K 2269 "Method of testing the pour point for petroleum products" or by measuring CFPP (cold filter plugging point) by using an automatic filter plugging point tester TAMEC-CFPP-AEI (manufactured and sold from Yoshida Kagaku Kiki K. K.) according to IP Standard 306/76.

Specifically, a glass test tube externally covered with a stainless tube is immersed in a bath maintained at −34° C., 45 ml of specimen is charged therein to cool and, by inserting a glass pipet attached at the top end thereof with a stainless net (filter) of 350 mesh (pore diameter 44 μ) into the specimen and sucking the specimen into the pipet under a reduced pressure of 200 mmAq. The CFPP value is a temperature value of the oil which is the temperature at which it takes a 20 ml specimen 60 seconds to rise up to a predetermined point on the scale of the pipette. The lower CFPP value (temperature) shows the lower temperature causing the plugging in the filter, that is, the better low-temperature fluidity.

EXAMPLE 1

[A-1] Preparation of reaction product of α-olefin and maleic anhydride

A flask was charged with 1.0 mol of α-olefin described in Table-1, 1.2 mol of maleic anhydride and 3.0 mol of xylene (6.0 mol of xylene were used in Experiment No. 7 and 3.0 mol of toluene were used in Experiment No. 8) and sufficiently replaced with nitrogen gas, and while adjusting the temperature to 100° C., 6.92 g (0.02 mol) of tertiary butyl peroctanoate (tertiary butyl peroxyester of 2-ethylhexanoate) (75% purity) were added and reacted for 6 hours under agitation. Then, the temperature was raised to distill off xylene, further unreacted α-olefin and maleic anhydride were removed under a reduced pressure and α-olefin - maleic anhydride copolymers (Experiment Nos. 1–8) were obtained. The weight average polymerization degree of the obtained copolymer was determined by the gel permeation chromatography and the molar ratio of α-olefin and maleic anhydride in the copolymer was determined by the elemental analysis, which are shown in Table-1 respectively.

In addition, 1.0 mol of α-olefin having the carbon atom number of 18 and 1.0 mol of maleic anhydride were charged into a one liter flask and, after nitrogen replacement, the temperature is raised to 200° C. under agitation and they were reacted at the same temperature for 8 hours. Then, unreacted α-olefin and maleic anhydride were distilled off while gradually increasing the pressure-reduction degree and 270 g of maleic anhydride adduct (Experiment No. 9) of α-olefin was obtained. The molar ratio in the addition of α-olefin and maleic anhydride was determined by measuring an acid value. The results are shown in Table-1.

TABLE 1

| A-I Experiment No. | Starting material, α-olefin: Kind*1 | Average carbon atom number | Average carbon atom number in the longest alkyl group chain | Reaction product of α-olefin and maleic anhydride: Weight average polymerization degree (n) | α-olefin/maleic anhydride (molar ratio) | Softening point (°C.) |
|---|---|---|---|---|---|---|
| 1 | DIALEN 14 | 14 | 12 | 28.6 | 1/1.3 | 105 |
| 2 | DIALEN 16 | 16 | 14 | 23.0 | 1/1.3 | 104 |
| 3 | DIALEN 18 | 18 | 16 | 27.7 | 1/1.3 | 104 |
| 4 | DIALEN 20 | 20 | 18 | 19.6 | 1/1.3 | 100 |
| 5 | DIALEN 168 | 16.5 | 14.5 | 27.3 | 1/1.2 | 104 |
| 6 | DIALEN 208 | 23 | 21 | 30.9 | 1/1.2 | 91 |
| 7 | DIALEN 18 | 18 | 16 | 14.2 | 1/1.3 | 103 |
| 8 | DIALEN 18 | 18 | 16 | 45.4 | 1/1.3 | 105 |
| 9 | DIALEN 18 | 18 | 16 | 1 | 1/1.1 | — |

(Note)
*1DIALEN is the trade mark of Mitsubishi Chemical Industries Limited, in which DIALEN 168 represents a mixture of α-olefins having carbon atom number of 16 and 18, DIALEN 208 represents a mixture of α-olefins having the carbon atom number of 20 to 28 and others represent single component α-olefins having a certain carbon atom number.

[A-II] Preparation-1 of Ingredient A

A one liter flask was charged with 146 g of the reaction product of α-olefin and maleic anhydride prepared in [A-I](Experiment No. 3) (amount containing 0.5 mol of acid anhydride group), 114 g (0.5 mol) of a synthetic alcohol having the carbon atom number of 15 (DIADOL-15, (trade mark), manufactured by Mitsubishi Chemical Industries Limited), 106 g (1.0 mol) of xylene and 1.8 g of paratoluene sulfonic acid, and they were heated to a temperature of 100° C. under agitation and reacted at the same temperature for 4 hours. After standing to cool, the liquid reaction mixture was transferred to a 2 liter separatory funnel, 500 cc of 2% aqueous sodium hydroxide solution was added thereto and separated them after shaking. After separating the aqueous layer, the oil layer was further washed twice with 500 cc of desalted water. After drying the oil layer over anhydrous sodium sulfate, xylene as a solvent was removed by distillation under a reduced pressure and 247 g of a hemi-esterification product of an α-olefin - maleic anhydride copolymer was obtained. The esterification degree thereof was determined as 48% by the measurement for the acid value.

From various reaction products of α-olefins and maleic anhydride prepared in [A-I] and alcohols shown in Table-2, various corresponding alcohol adducts were prepared in the same procedures. Each ingredient A thus prepared is shown in Table-3.

By the way, the low-temperature fluidity tests were carried out by using the xylene solution as it was without isolating esterified products.

TABLE 2

| No. | Alcohol | Average carbon atom number | Average carbon atom number in the longest carbon chain |
|---|---|---|---|
| 1 | DIADOL - 7*2 | 7 | 6.5 |
| 2 | DIADOL - 9 | 9 | 8.5 |
| 3 | DIADOL - 11 | 11 | 10.5 |
| 4 | DIADOL - 13 | 13 | 12.5 |
| 5 | DIADOL - 15 | 15 | 14.5 |
| 6 | DIADOL - 17 | 17 | 16.5 |
| 7 | DIADOL - 19 | 19 | 18.5 |
| 8 | DIADOL - 21 | 21 | 20.5 |
| 9 | DIADOL - 18G*3 | 18 | 9.0 |
| 10 | DIADOL - 26G*4 | 26 | 13.0 |

(Note)
*2DIADOL represents the trade mark of Mitsubishi Chemical Industries Limited.
*3Branched chain alcohol obtained by dimerization of Alcohol No. 2.
*4Branched chain alcohol obtained by dimerization of Alcohol No. 4.

TABLE 3

| No. | Reaction product of α-olefin and maleic anhydride: A-I No. | Average carbon atom number in the longest alkyl group chain | Alcohol: Table-2 No. | Average carbon atom number in the longest carbon chain | Sum of the carbon atom number in the longest side chain*5 |
|---|---|---|---|---|---|
| A-1 | 1 | 12 | 6 | 16.5 | 28.5 |
| A-2 | 2 | 14 | 6 | 16.5 | 30.5 |
| A-3 | 3 | 16 | 5 | 14.5 | 30.5 |
| A-4 | 4 | 18 | 4 | 12.5 | 30.5 |
| A-5 | 4 | 18 | 10 | 13.0 | 31.0 |
| A-6 | 6 | 21 | 3 | 10.5 | 31.5 |
| A-7 | 9 | 16 | 5 | 14.5 | 30.5 |
| A-8 | 9 | 16 | 6 | 16.5 | 32.5 |
| A-9 | 1 | 12 | 3 | 10.5 | 22.5 |
| A-10 | 2 | 14 | 3 | 10.5 | 24.5 |
| A-11 | 3 | 16 | 2 | 8.5 | 24.5 |
| A-12 | 3 | 16 | 9 | 9.0 | 25.0 |
| A-13 | 4 | 18 | 7 | 18.5 | 36.5 |
| A-14 | 6 | 21 | 6 | 16.5 | 37.5 |
| A-15 | 9 | 16 | 2 | 8.5 | 24.5 |
| A-16 | 7 | 16 | 5 | 14.5 | 30.5 |
| A-17 | 8 | 16 | 5 | 14.5 | 30.5 |

(Note)
*5Sum of the average carbon atom number in the longest alkyl group chain of the α-olefin and the average carbon atom number in the longest carbon chain of the alcohol.

TABLE 4

| No. | Reaction product of α-olefin and maleic anhydride: A-I No. | Average carbon atom number in the longest alkyl group chain | Alcohol: Table-2 No. | Average carbon atom number in the longest carbon chain | Sum of the carbon atom number in the longest side chain |
|---|---|---|---|---|---|
| A-18* | 1 | 12 | 1 | 6.5 | 18.5 |
| A-19 | 1 | 12 | 2 | 8.5 | 20.5 |
| A-20 | 1 | 12 | 6 | 16.5 | 28.5 |
| A-21 | 1 | 12 | 7 | 18.5 | 30.5 |
| A-22* | 2 | 14 | 1 | 6.5 | 20.5 |
| A-23 | 2 | 14 | 5 | 14.5 | 28.5 |
| A-24 | 3 | 16 | 5 | 14.5 | 30.5 |
| A-25 | 4 | 18 | 1 | 6.5 | 24.5 |
| A-26 | 4 | 18 | 3 | 10.5 | 28.5 |
| A-27 | 4 | 18 | 4 | 12.5 | 30.5 |
| A-28 | 4 | 18 | 5 | 14.5 | 32.5 |
| A-29 | 4 | 18 | 7 | 18.5 | 36.5 |
| A-30 | 4 | 18 | 8 | 20.5 | 38.5 |
| A-31 | 5 | 14.5 | 5 | 14.5 | 29.0 |
| A-32* | 6 | 21 | 8 | 20.5 | 41.5 |
| A-33 | 7 | 16 | 5 | 14.5 | 30.5 |
| A-34 | 8 | 16 | 5 | 14.5 | 30.5 |
| A-35 | 9 | 16 | 5 | 14.5 | 30.5 |

(Note)
In the table, "*" represents Comparative Examples.

[A-II] Preparation-2 of Ingredient A

A one liter flask was charged with 290.5 g of reaction product of α-olefin and maleic anhydride (amount containing 1.0 mol of acid anhydride group) prepared in [A-I](Experiment No. 8), a synthetic alcohol having the carbon atom number of 13 [DIADOL-13 (trade mark) manufactured by Mitsubishi Chemical Industries Limited ] and 122.3 g of xylene, heated to a temperature of 100° C. under agitation, reacted at the same temperature for 4 hours and 486 g of a hemi-esterification product of the reaction product of α-olefin and maleic anhydride. The degree of esterification of the obtained adduct was determined as 48% by the measurement of the acid value.

Various corresponding adducts were prepared in the same procedures from the reaction products of α-olefins and maleic anhydride and alcohols shown in Table-2. For the comparison, adducts having the sum of the carbon atom number in the longest side chain being less than 22 or in excess of 40 were also prepared. The adducts obtained in this Preparation Example are shown in Table-4.

[A-II] Preparation-3 of Ingredient A

In a 500 ml flask, 306.6 g of the adduct (A-31) obtained in Preparation-2 of Ingredient A as described above and 33 g of potassium hydroxide (85% purity) were heated to 135°–140° C. under agitation, the produced water was removed out of the reaction system, an appropriate amount of xylene was added for the adjustment of the concentration and a potassium salt of the adduct was produced.

In the foregoing procedures, 30.25 g of aqueous ammonia (28%) were used in place of potassium hydroxide and reacted for one hour at 40° C. After the reaction, water was gradually removed under a reduced pressure (40° C./5 mmHg) out of the reaction system, an appropriate amount of xylene was added for the adjustment of the concentration and an ammonium salt of the adduct was produced.

In the same manner, salts of adducts from various reaction products of α-olefins and maleic anhydride and alcohols shown in Table-2 were prepared. Addition products having the sum of the carbon atom number in the longest side chain being less than 22 or in excess 40 were prepared for the comparison also in this Preparation Example. Salts of the adducts obtained in this Preparation Example are shown in Table-5.

TABLE 5

| No. | Reaction product of α-olefin and maleic anhydride: No. | Average carbon atom number in the longest alkyl group chain | Alcohol: No. | Average carbon atom number in the longest carbon chain | Sum of the carbon atom number in the longest side chain | Type of salt |
|---|---|---|---|---|---|---|
| A-36* | 1 | 12 | 1 | 6.5 | 18.5 | K salt |
| A-37 | 1 | 12 | 7 | 18.5 | 30.5 | K salt |
| A-38 | 1 | 12 | 8 | 20.5 | 32.5 | K salt |
| A-39 | 2 | 14 | 5 | 14.5 | 28.5 | K salt |
| A-40 | 3 | 16 | 5 | 14.5 | 30.5 | K salt |
| A-41 | 4 | 18 | 1 | 6.5 | 24.5 | K salt |
| A-42 | 4 | 18 | 3 | 10.5 | 28.5 | K salt |
| A-43 | 4 | 18 | 5 | 14.5 | 32.5 | K salt |
| A-44* | 5 | 14.5 | 1 | 6.5 | 21.0 | K salt |
| A-45 | 5 | 14.5 | 4 | 12.5 | 27.0 | K salt |
| A-46 | 5 | 14.5 | 5 | 14.5 | 29.0 | K salt |

TABLE 5-continued

| No. | Reaction product of α-olefin and maleic anhydride: No. | Average carbon atom number in the longest alkyl group chain | Alcohol: No. | Average carbon atom number in the longest carbon chain | Sum of the carbon atom number in the longest side chain | Type of salt |
|---|---|---|---|---|---|---|
| A-47 | 5 | 14.5 | 6 | 16.5 | 31.0 | K salt |
| A-48* | 6 | 21 | 8 | 20.5 | 41.5 | K salt |
| A-49 | 7 | 16 | 5 | 14.5 | 30.5 | K salt |
| A-50 | 8 | 16 | 5 | 14.5 | 30.5 | K salt |
| A-51 | 9 | 16 | 5 | 14.5 | 30.5 | K salt |
| A-52 | 5 | 14.5 | 5 | 14.5 | 29.0 | $NH_4$ salt |

(Note)
In the table, "*" represents Comparative Example.

[B] Preparation-1 of Ingredient B

A one liter flask was charged with 600 g of α-olefin having the average carbon atom number of 48 [DIALEN 30 (trade mark), numerical average molecular weight of 690, manufactured by Mitsubishi Chemical Industries Limited] and 90.0 g of maleic anhydride, after nitrogen replacement, 4.56 g of ditertiary butyl peroxide were added under agitation at the temperature condition of 180° C. and the reaction was carried out for 4 hours. Then, unreacted maleic anhydride was distilled off while gradually increasing the pressure-reduction degree and 690 g of α-olefin - maleic anhydride copolymer (B-1) was obtained. The weight average polymerization degree of the obtained copolymer was determined as 12.5 by gel permeation chromatography.

In the same manner, α-olefin -maleic anhydride copolymers (B-2 and B-3, in which DIALEN 18 having the molecular weight of 288 was used in B-3 for the comparison) were prepared while changing the charging amount of maleic anhydride or the type of α-olefin.

Further, the adducts (B-4 and B-5) of α-olefin-maleic anhydride were prepared in the same manner as above excepting that di-tertiary butyl peroxide was not added and the reaction was carried out at 220° C. for 8 hours. The results are shown in Table-6.

TABLE 6

| No. | Starting material, α-olefin | Average carbon atom number | α-olefin/maleic anhydride (weight ratio) | Saponification value |
|---|---|---|---|---|
| B-1 | DIALEN 30 | 48 | 100/15 | 109 |
| B-2 | DIALEN 30 | 48 | 100/10 | 82 |
| B-3* | DIALEN 18 | 18 | 100/47 | — |
| B-4 | DIALEN 30 | 48 | 100/15 | 107 |
| B-5 | DIALEN 30 | 48 | 100/10 | 88 |

(Note)
In the table, "*" represents Comparative Example.

[B] Preparation-2 of Ingredient B

A 2-liter flask was charged with 1000 g of low molecular weight polyethylene having the numerical average molecular weight of about 3500 (grease wax obtained as a by-product upon production of polyethylene) and 30 g of maleic anhydride, after nitrogen replacement, 2.2 g of ditertiary butyl peroxide were added under agitation at the temperature condition of 160° C. and the reaction was carried out for 4 hours. Then, while gradually increasing the degree of pressure-reduction, unreacted maleic anhydride was distilled off and 1028.7 g of low molecular weight polyethylene - maleic anhydride copolymer (B-6) having the weight average molecular weight of about 6400 was obtained.

In the same manner, copolymers of low molecular weight polyethylene - maleic anhydride copolymers (B-7, B-8 and B-9, in which B-9 is an example using low molecular weight polyethylene having the numerical average molecular weight in excess of 20,000 as the comparison) were prepared while changing the charging amount of maleic anhydride and the type of low molecular weight polyethylene. The results are shown in Table-7.

TABLE 7

| No. | Low molecular weight polyethylene (molecular weight) | Low molecular weight polyethylene/maleic anhydride (polymerization ratio) | Saponification value |
|---|---|---|---|
| B-6 | about 3500(1) | 100/3.0 | 28.8 |
| B-7 | about 3500(1) | 100/2.5 | 23.5 |
| B-8 | about 3500(1) | 100/1.0 | 9.6 |
| B-9* | about 45000(2) | 100/0.5 | — |

(Note)
"*" represents Comparative Example,
(1)numerical average molecular weight,
(2)weight average molecular weight.

[C] Low-Temperature Fluidity Test - 1

Low temperature fluidity was evaluated for the compositions comprising A-1 to A-17 as the ingredient A and the branched polyethylene having the numerical average molecular weight of 3600 as the ingredient B. That is, the ingredient A and the ingredient B were added by 500 ppm respectively to fuel oils composed of commercially available light-weight light oil and heavier light oil shown in Table-8 blended in a weight ratio 80:20, and the low-temperature fluidity test was carried out in accordance with the procedures as described before. The results are shown in Table-9.

The results of the low-temperature fluidity test carried out in the same manner for the fuel oil with no addition of the ingredient B as the Reference Test Examples are also shown in Table-9.

Further, the test results for the low-temperature fluidity for the fuel oils with no addition of the ingredient A or both of the ingredient A and the ingredient B are also shown in Table-9 (refer to No. 16).

TABLE 8

| | Commercially available light-weight light oil | Heavier light oil |
|---|---|---|
| Specific gravity (15/4° C.) | 0.8356 | 0.8735 |
| Sulfur content (% by weight) | 0.60 | 1.72 |

TABLE 8-continued

| | Commercially available light-weight light oil | Heavier light oil |
|---|---|---|
| Pour point (°C.) | −7.5 | +12.5 |
| Flash point (°C.) | 72 | 156 |
| Kinematic viscocity (cst/50° C.) | 2.71 | 6.76 |

TABLE 9

| No. | Ingredient A | CFPP (°C.) Ingredient B added | CFPP (°C.) Ingredient B not added (Reference Example) |
|---|---|---|---|
| 1 | A-1 | −13 | −2 |
| 2 | A-2 | −14 | −1 |
| 3 | A-3 | −12 | −1 |
| 4 | A-4 | −10 | 0 |
| 5 | A-5 | −13 | −1 |
| 6 | A-6 | −6 | 0 |
| 7 | A-7 | −13 | −2 |
| 8 | A-8 | −13 | −1 |
| 9 | A-9 | −4 | −1 |
| 10 | A-10 | −5 | 0 |
| 11 | A-11 | −4 | −1 |
| 12 | A-12 | −4 | 0 |
| 13 | A-13 | −4 | 0 |
| 14 | A-14 | −4 | 0 |
| 15 | A-15 | −4 | −1 |
| 16 | — | −4 | −2 |
| 17 | A-16 | −15 | −2 |
| 18 | A-17 | −10 | −1 |

[C] Low-Temperature Fluidity Test - 2

Five hundred ppm of the ingredient A previously prepared in Preparation-2 of Ingredient A [A-II] and 500 ppm of the ingredient B were added to a fuel oil composed of commercially available light-weight light oil (cst/50° C.) and heavier light oil (specific weight 0.9012, sulfur content 2.4, pour point +22.5° C., flash point 144° C. and kinematic viscosity 11.68 cst/50° C.) shown in Table-8 blended in a weight ratio 80:20 and the test for the low-temperature fluidity was carried out. The results are shown in Table-10. The results for the case where the ingredient A or ingredient B was added singly, are also shown as the Reference Example in Table-10. Further, the results for the case where none of the ingredients A and B was added and where A-18, A-19, A-22 or A-32 was added as the ingredient A and B-3 or B-9 was added as the ingredient B, are also shown as the Reference Examples in Table-11.

TABLE 10

| No. | Ingredient A | CFPP (°C.) Ingredient B added | | CFPP (°C.) Ingredient B not added (Reference Example) |
|---|---|---|---|---|
| 1 | A-31 | B-1 | −14 | +4 |
| 2 | A-31 | B-5 | −11 | — |
| 3 | A-31 | B-8 | −14 | — |
| 4 | A-21 | B-8 | −15 | +4 |
| 5 | A-23 | B-8 | −15 | +4 |
| 6 | A-24 | B-8 | −13 | +5 |
| 7 | A-25 | B-8 | −12 | +4 |
| 8 | A-26 | B-8 | −14 | +4 |
| 9 | A-27 | B-8 | −16 | +4 |
| 10 | A-28 | B-8 | −14 | +4 |
| 11 | A-29 | B-8 | −11 | +4 |
| 12 | A-30 | B-8 | −11 | +4 |
| 13 | A-33 | B-8 | −14 | +4 |
| 14 | A-34 | B-8 | −11 | +4 |
| 15 | A-35 | B-8 | −12 | +4 |
| 16* | — | B-1 | +1 | — |

TABLE 10-continued

| No. | Ingredient A | CFPP (°C.) Ingredient B added | | CFPP (°C.) Ingredient B not added (Reference Example) |
|---|---|---|---|---|
| 17* | — | B-5 | +2 | — |
| 18* | — | B-8 | −6 | — |

(Note)
*also represents Reference Examples.

TABLE 11

| No. | Ingredient A | Ingredient B | CFPP (°C.) |
|---|---|---|---|
| 1 | — | — | +5 |
| 2 | A-31 | B-3* | +4 |
| 3 | A-31 | B-9* | +3 |
| 4 | A-19* | B-8 | −6 |
| 5 | A-22* | B-8 | −5 |
| 6 | A-32* | B-8 | −6 |

(Note)
In the table, the components attached with "*" represent the ingredient for the comparison.

[C] Low-Temperature Fluidity Test - 3

To the same fuel oils as used in the low-temperature fluidity test-2, were added 150 ppm of the ingredient A as prepared in Preparations-2 and -3 of Ingredient A in [A-II] and 150 ppm of branched polyethylene having the numerical average molecular weight of 3600 as the ingredient B and the low-temperature fluidity tests were carried out. The results are shown in Table-12. The result for the case where the ingredient A or B was not added as the Reference Example and the result for the case where A-36, A-44 or A-48 was added as the Comparative Example, are also shown in Table-12.

TABLE 12

| No. | Ingredient A | CFPP (°C.) Ingredient B added | CFPP (°C.) Ingredient B not added (Reference Example) |
|---|---|---|---|
| 1* | — | −1 | +5 |
| 2* | A-36 | 0 | +4 |
| 3 | A-37 | −12 | +2 |
| 4 | A-38 | −12 | +2 |
| 5 | A-39 | −10 | +1 |
| 6 | A-40 | −10 | 0 |
| 7 | A-41 | −8 | +1 |
| 8 | A-42 | −8 | 0 |
| 9 | A-43 | −6 | +1 |
| 10* | A-44 | +1 | +3 |
| 11 | A-45 | −11 | +3 |
| 12 | A-46 | −10 | +3 |
| 13 | A-47 | −10 | +2 |
| 14* | A-48 | −1 | +2 |
| 15 | A-49 | −10 | +1 |
| 16 | A-50 | −8 | +2 |
| 17 | A-51 | −9 | 0 |
| 18 | A-52 | −11 | +1 |
| 19 | A-31 | −5 | +4 |

(Note)
*represents Comparative Examples.

[C] Low-Temperature Fluidity Test - 4

To the same fuel oils as used in the low-temperature fluidity test - 2, were added 150 ppm of A-46 or A-52 as the ingredient A and 150 ppm of B-8 as the ingredient B, and the low-temperature fluidity test was carried out. The results are shown in Table-13. The result for the case where the ingredient A or B was not added, is also shown as the Reference Example in Table-13.

TABLE 13

| No. | Ingredient A | CFPP (°C.) Ingredient B added | Ingredient B not added (Reference Example) |
|---|---|---|---|
| 1 | A-46 | −7 | −1 |
| 2 | A-52 | −12 | +1 |
| 3* | — | 0 | — |

(Note)
"*" also represents Reference Example.

[C] Low-Temperature Fluidity Test - 5

To Minas A heavy oil having the pour point of 5° C., was added the ingredient A as prepared in Preparation-2 of Ingredient A [A-II] and the ingredient B, and the pour point was measured. The results are shown in Table-14. The result for the case where none of the ingredient A and the ingredient B was added, where the ingredient A-18 or A-32 was added as the ingredient A and B-3 was added as the ingredient B (refer to Nos. 8–11) as the Comparative Example and the result for the case where the ingredient A or ingredient B was added solely (refer to Nos. 12–15) as the Reference Example, are also shown in Table-14.

TABLE 14

| No. | Ingredient A Kind | Ingredient A Addition amount (ppm) | Ingredient B Kind | Ingredient B Addition amount (ppm) | Pour point (°C.) |
|---|---|---|---|---|---|
| 1 | A-20 | 667 | B-7 | 333 | −5.0 |
| 2 | A-23 | 667 | B-7 | 333 | −7.5 |
| 3 | A-24 | 667 | B-7 | 333 | −7.5 |
| 4 | A-26 | 667 | B-7 | 333 | −5.0 |
| 5 | A-31 | 667 | B-7 | 333 | −10.0 |
| 6 | A-31 | 667 | B-2 | 333 | −7.5 |
| 7 | A-31 | 667 | B-4 | 333 | −5.0 |
| 8* | — | — | — | — | +5.0 |
| 9* | A-18 | 667 | B-7 | 333 | +5.0 |
| 10* | A-32 | 667 | B-7 | 333 | +5.0 |
| 11* | A-31 | 667 | B-3 | 333 | +5.0 |
| 12** | A-31 | 1000 | — | — | +5.0 |
| 13** | — | — | B-7 | 1000 | +7.5 |
| 14** | — | — | B-2 | 1000 | +5.0 |
| 15** | — | — | B-4 | 1000 | +5.0 |

(Note)
"*" represents Comparative Example and
"**" represents Reference Example respectively.

INDUSTRIAL APPLICABILITY

The low-temperature fluidity improver obtained by the method according to this invention has an effect of maintaining the fluidity of hydrocarbon fuel oils at a low temperature and it is particularly useful as additives for fuel oils in case of using internal combustion engines in cold districts.

We claim:

1. A low-temperature fluidity improver, comprising:
   (A) an adduct formed by adding a reaction product having the weight average polymerization degree of 1 to 100, which is prepared by the reaction of an α-olefin having the average carbon atom number of 10 to 30 and maleic anhydride, the constitutent molar ratio of α-olefin and maleic anhydride in the reaction product being between 1:1 to 1:2, to an aliphatic alcohol having the average carbon atom number of 6 to 28, in which the sum of the average carbon atom number in the longest alkyl group chain of the α-olefin and the average carbon atom number in the longest carbon chain of the aliphatic alcohol is 22 to 40, the aliphatic alcohol reacting with said reaction product in an amount of 0.5 to 1.5 mole per mole of anhydride group in the reaction product, and/or a salt of said adduct, and
   (B) a low molecular weight polyethylene having a number average molecular weight of 500 to 20,000 and/or a reaction product obtained by reacting said low molecular weight polyethylene with 0.1 to 40% by weight maleic anhydride.

2. The low-temperature fluidity improver as defined in claim 1, wherein the weight average polymerization degree of the reaction product prepared from α-olefin and maleic anhydride is 1 to 45.

3. The low-temperature fluidity improver as defined in claim 1 or claim 2, wherein the sum of the average carbon atom number in the longest alkyl group chain of the α-olefin and the average carbon atom number in the longest carbon chain of the aliphatic alcohol is 24 to 34.

* * * * *